US005181721A

United States Patent [19]

Halliburton

[11] Patent Number: 5,181,721

[45] Date of Patent: Jan. 26, 1993

[54] GOLF GAME APPARATUS

[75] Inventor: Ronald Halliburton, Boca Raton, Fla.

[73] Assignee: Jeron Technology, Inc., Pompano Beach, Fla.

[21] Appl. No.: 691,731

[22] Filed: Apr. 26, 1991

[51] Int. Cl.[5] ..... A63B 69/36

[52] U.S. Cl. ..... 273/177 A; 273/181 R; 273/181 H; 273/181 J; 273/184 A; 273/378; 273/390; 273/183.1

[58] Field of Search ..... 273/181 R, 181 A, 181 H, 273/181 J, 34, 177 R, 177 A, 177 B, 35 R, 183 R, 184 R, 184 A, 378, 382, 386, 390, 391, 392, 127 R, 127 D

[56] References Cited

U.S. PATENT DOCUMENTS

| | | | |
|---|---|---|---|
| 1,742,702 | 1/1930 | Goodloe | 273/177 A |
| 2,988,363 | 6/1961 | Hall | 273/181 A |
| 3,082,005 | 3/1963 | Kron | 273/184 R |
| 3,559,996 | 2/1971 | Hopp | 273/176 |
| 3,778,064 | 12/1973 | Nutter | 273/176 FA |
| 3,791,653 | 2/1974 | Yamada | 273/185 R |
| 3,873,097 | 3/1975 | Willis | 273/127 D |
| 3,892,414 | 7/1975 | Glasson et al. | 273/185 R |
| 4,150,825 | 4/1979 | Wilson | 273/185 B |
| 4,327,917 | 5/1982 | Bagley | 273/127 D |
| 4,343,469 | 8/1982 | Kunita et al. | 273/185 A |
| 4,568,085 | 2/1986 | Tate | 273/127 D |
| 4,761,009 | 8/1988 | Gibree | 273/177 R |

FOREIGN PATENT DOCUMENTS

| | | | |
|---|---|---|---|
| 2232604 | 12/1990 | United Kingdom | 273/181 R |

*Primary Examiner*—V. Millin
*Assistant Examiner*—Jessica J. Harrison
*Attorney, Agent, or Firm*—Oltman and Flynn

[57] ABSTRACT

A golf game apparatus which has at least three rotatable targets activatable by a golf ball, which has a horizontal supporting arrangement for rotatably supporting the targets, wherein each target has a rest position indicating a forward facing target surface in the rest position; a rotation-detecting arrangement coupled to each target, a computing arrangement coupled to the rotation-detecting arrangement for computing game-related scores and parameters.

19 Claims, 4 Drawing Sheets

GOLF GAME APPARATUS

The invention relates to a golf game apparatus for playing and practicing golf and more particularly for practicing golf in an environment emulating a golf course.

BACKGROUND OF THE INVENTION

For golf players it is frequently desirable to have means available that allows the player to practice various aspects of the game in a setting away from a regular golf course. The present invention addresses such practice means and especially the putting aspect of the game.

Inventors have in the past disclosed devices for aiding a player in practicing the putting of a golf ball. U.S. Pat. No. 3,892,414 shows a golf ball direction indicator in which a photosensitive element is placed in front of a golf ball with three other photosensitive elements for indicating a straight, a left or a right ball and a timer coupled to the photosensitive elements for computing the speed of the ball. U.S. Pat. No. 4,434,469 shows a golf game practicing apparatus for simulating practicing of putting shots. It has a curved curb for receiving balls from a starting point and a display for displaying and computing an imaginary ball trajectory.

The known game apparatus, however, suffer from the drawbacks that they do not emulate an actual golf playing environment in which scores are earned and displayed, based on the degree of putting skill exhibited, nor do they emulate the environment in which several players can compete against each other and play various types of games, such as "shootout", "skins", and the like.

It is accordingly an object of the instant invention to provide a golf game playing apparatus that to a high degree realistically emulates golf as played on a putting green optionally with a number of participating players, which computes the scores of each layer, provides feedback as to the distance each ball would actually have run on an actual putting green, and which allows the players to engage in various types of games.

SUMMARY OF THE INVENTION

In accordance with the instant invention there is provided a golf game apparatus which has at least three rotatable targets activatable by a golf ball, which has a horizontal supporting arrangement for rotatably supporting the targets, wherein each target has a rest position indicating a forward facing target surface in the rest position; a rotation-detecting arrangement coupled to each target, a computing arrangement coupled to the rotation-detecting arrangement for computing game-related scores and parameters, and a display arrangement for displaying the scores and parameters.

The golf game apparatus may additionally include a housing which has two opposite end panels for supporting the ends of the horizontal shaft, a faceplate for holding the parameter and data display, and a compartment for holding the computing apparatus.

In accordance with a further feature there is provided a golf game apparatus which has a light-reflecting area on the rotating targets as part of the rotation-detecting arrangement, a light source for illuminating the reflecting area; and a light sensor for sensing reflected light from the reflecting area coupled to the computing arrangement for indicating each turn of the rotatable targets.

In accordance with still another feature there is provide a golf game apparatus which as data storage coupled to the computing arrangement for receiving game-related data, wherein the game-related data include a putt distance from the golf game apparatus, an estimated greens speed for the putting surface, a game type, and the number of participating players.

According to a still further feature of the golf game apparatus according to the invention, the rotatable targets include a center target, and at least one left target and at least one right target, wherein the horizontal supporting arrangement is a horizontal shaft with some spacing arrangement on the shaft for horizontally spacing the rotatable targets on the shaft.

The golf game apparatus according to the invention may further include a microprocessor, a program memory for storing control programs coupled to the microprocessor, and indicators coupled to the microprocessor for indicating the game-related parameters and/or the game-related data, and it may further include a numeric light-emitting diode (LED) display in the indicator, wherein the displayed golf game-related parameters include at least computed ball speed, computed score and computed ball distance based on the ball speed and type of greens, and the programs may further include a plurality of states, each state including at least one event for entry into the state.

The golf game apparatus according to the invention may further include at least one of a distance computation module, a ball velocity computation module, a game setup module, an end-of-player/game-over module, a sound control module, a display control module and/or a score computation module.

The face plate may also hold an on/off switch and keys for manually entering game data.

Further objects and advantages of this invention will be apparent from the following detailed description of a presently preferred embodiment which is illustrated schematically in the accompanying drawings.

DESCRIPTION OF THE PREFERRED EMBODIMENTS

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

Figure 1:
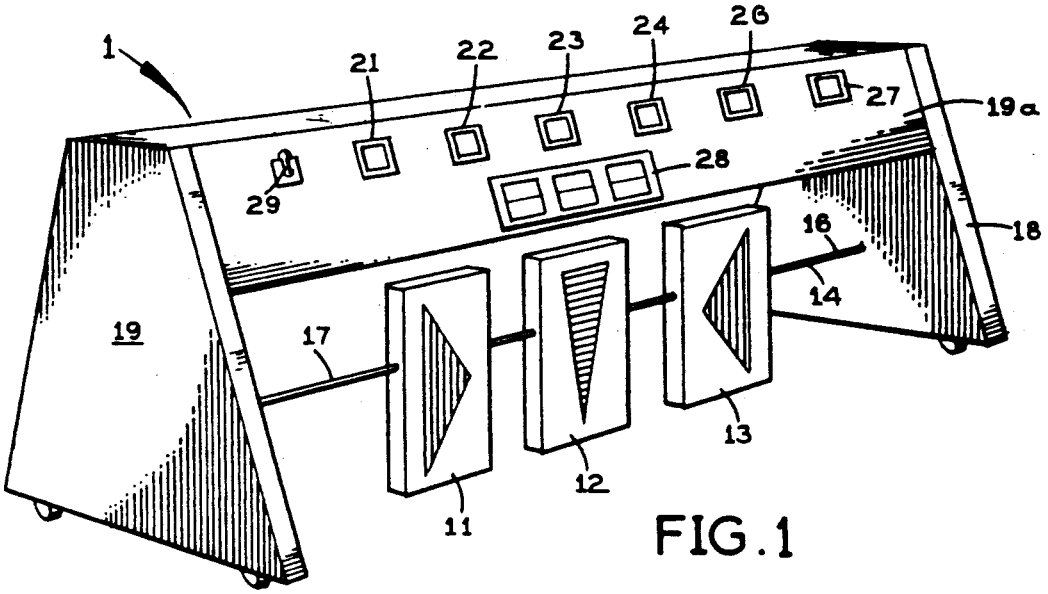
FIG. 1 is a perspective view of the invention showing the housing with end and face panels, and rotating targets.

FIG. 1 is a perspective view of the housing for the game apparatus 1, wherein a number, e.g. three, elongate targets 11,12, and 13 are rotatably mounted on a shaft 14, having its two ends 16,17 supported in two opposite mutually facing end panels 18,19. The targets 11,12,13 are loosely rotatable, but slightly overweighted at one end so that they always come to rest in their vertical position, as shown.

A face panel 19 holds various light-emitting diodes 21–24, manual switches 26,27 for entering and selecting certain game-related input data, and a numeric light-emitting display (LED) 28, which serves to display scores, entered game data, and computed parameters during the course of a game.

An on-off switch 29 serves to switch the game apparatus on and off.

Various electronic components, such as a microprocessor, memories and the like are mounted on a circuit board placed in a compartment behind the face panel 19.

In playing a game, one or several players in turn take a stance in front of the apparatus at a given distance therefrom measured e.g. in feet. Each player in turn, strikes a golf ball, aiming to hit the center target 12. When the ball hits one of the targets 11–13, it sets the target in a spinning motion about the shaft 14. The speed of the ball translates into a proportional rotational speed (RPM) of the target. The target spins and slowly comes to a stop at about the same time the ball would have stopped on a real green for the corresponding distance of a putt.

Figure 6:
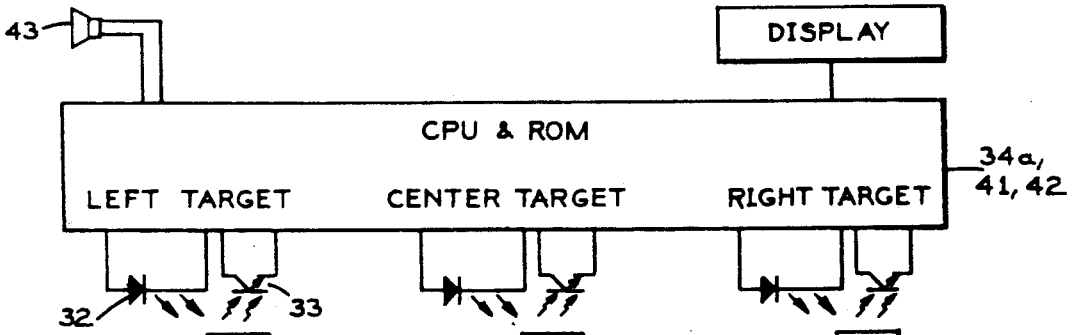
FIG. 6 is a simplified block diagram of the invention.
Figure 7:
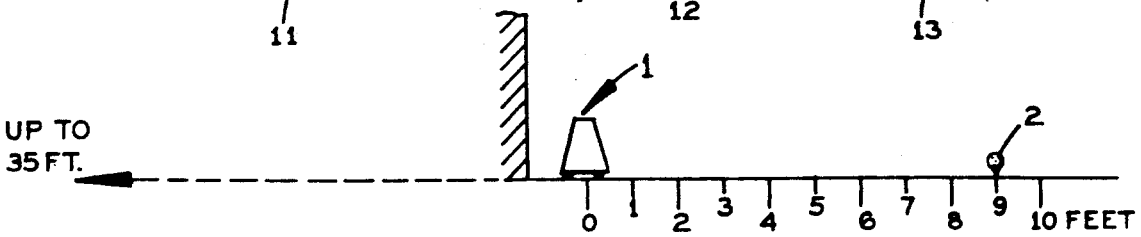
FIG. 7 is a diagrammatic view of the game apparatus ready to be played.
Figure 4:
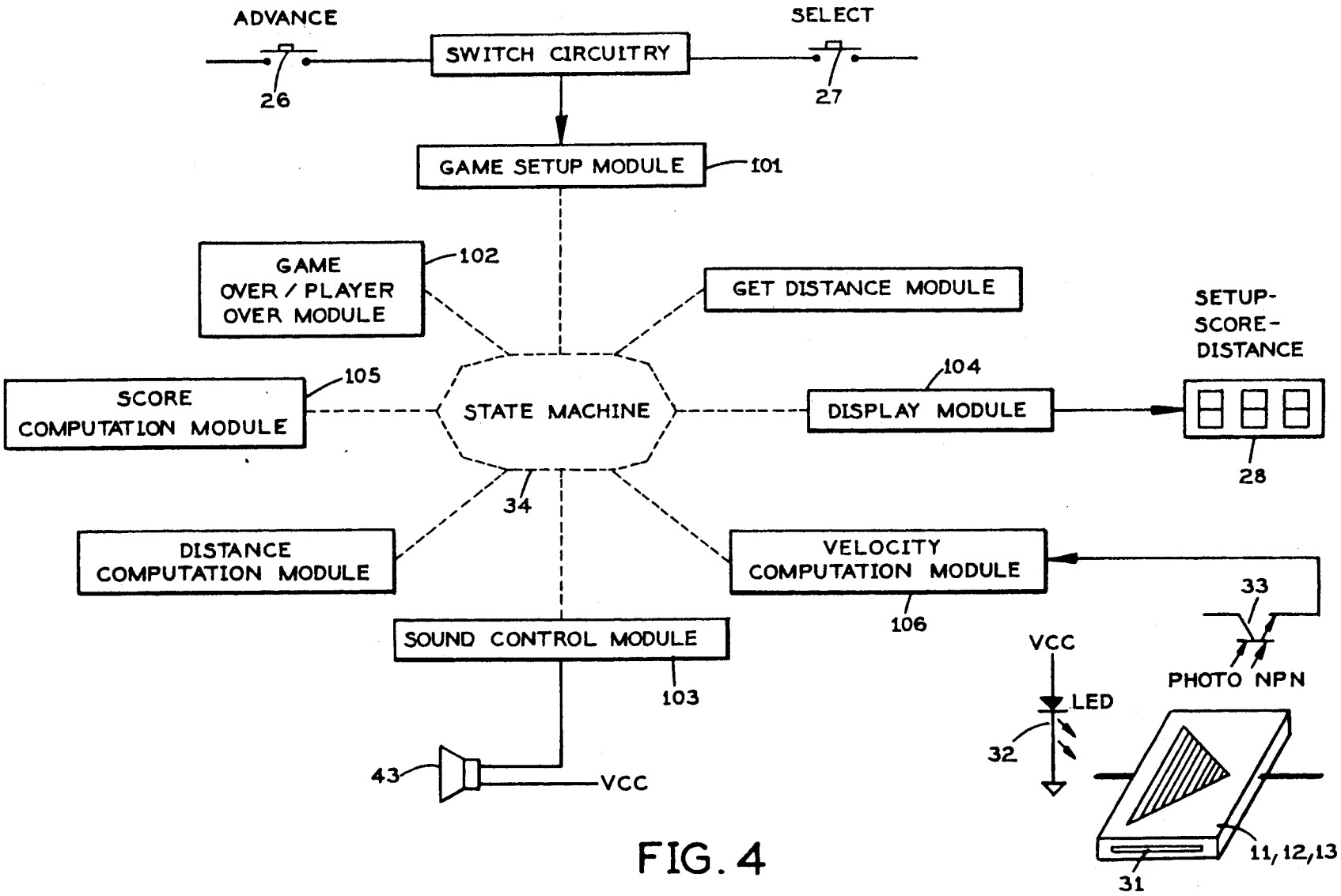
FIG. 4 is a view showing the program structure with the major program modules of the control program, and its ancillary hardware.

The RPM is measured electronically so as not to further dampen the rotation. Advantageously the RPM is measured by means of a piece of reflective tape 31 mounted on one end of the target as seen in FIG. 4 and 6. The tape 31 is exposed to light from a light-emitting diode 32 mounted immediately above each target. A photo sensor 33 is mounted next to the light emitting diode 32, which emits a series of pulses as the target is spinning from the impact of the ball. The time difference between the two first pulses is a measure of the speed of the ball. The time difference is measured electronically in well known manner by a velocity computation module 14 connected to the main computer program, shown as a "state machine" 34 in FIG. 4. The computed velocity of the ball is entered into the state machine 34 and is one of the computed parameters used during the game.

Game scoring points are computed according to whether the center target 12 or one of the side targets 11,13 are activated, in accordance with scoring rules that can vary, depending upon which of a number of available types of games is selected by the players, as described in more detail below.

Figure 5:
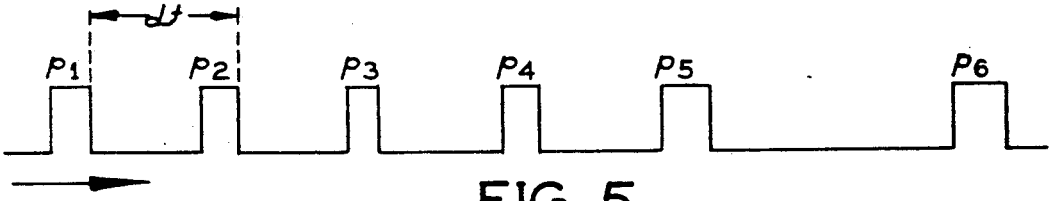
FIG. 5 is a timing diagram of pulses generated by the rotating targets.

FIG. 5 shows pulses p1–p5 generated by the photo diode 33 as the target rotates. The time dt between e.g. the two first pulses p1–p2 translates into an RPM which is signal to 1/dt with dt measured in minutes. Gradually the target will slow down and come to a stop in the vertical position due to the unavoidable friction between the target and the shaft 14.

FIG. 6 shows a simplified block diagram of the game apparatus with the three targets 11,12,13 rotatably mounted on a shaft 14, each having the motion detectors, the LED's 32 and the photo sensors 33 positioned above it. The microprocessor 34*a*, with memories 41,42 is connected to the motion detectors, and a speaker 43 and display 28 are connected to the computer. The speaker operates to emit sound signals at selected points of the game being played.

Figure 2:
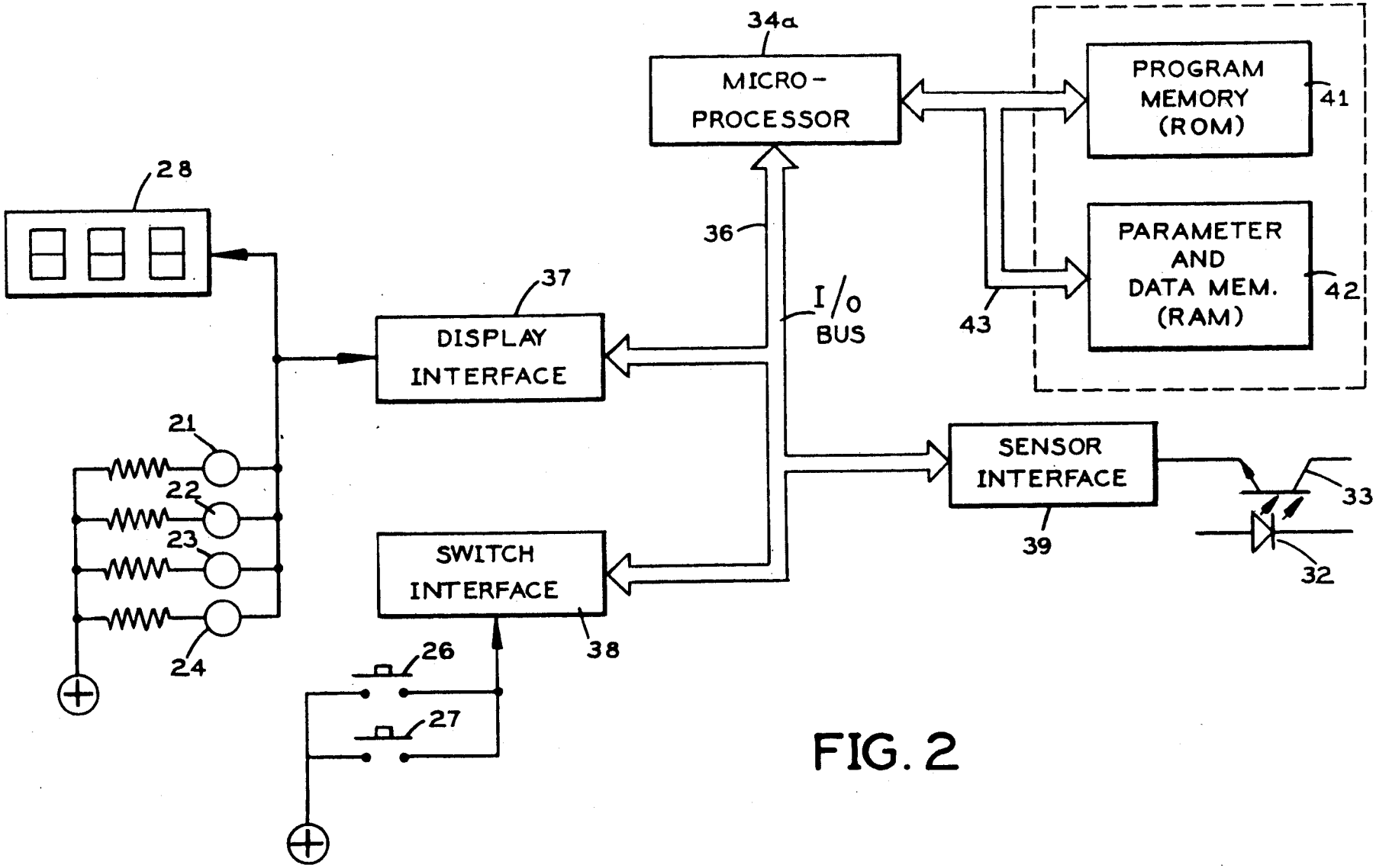
FIG. 2 is a block diagram of the invention showing its major building blocks.

FIG. 2 shows further details of the electronic control hardware, wherein the microprocessor 34*a* of conventional construction is connected to an input/output bus 36, which in turn interacts with a display interface 37, connected to LED's 21–24, and an LED numeric display 28, arranged to display, e.g. three digits. A switch interface 38 responds to the operation of two manual switches 26,27 and reports operation of these switches to the microprocessor 34*a* via I/O bus 36. A sensor interface 39 responds to the photo sensors 33 and reports the spinning action of any of the targets 11–13 to the microprocessor 34*a*.

A computer control program is stored in a program memory 41, which is advantageously of the type known as a ROM 41 (Read Only Memory). As is well known, transient data such as computed parameters, intermediate variables and game input data are stored in a RAM 42 (Random Access Memory). The ROM 41 and the RAM 42 communicate with the microprocessor 34*a* via a memory bus 43, or may communicate directly via the I/O bus 36, depending on the type of microprocessor used. The control program in the ROM 41 is divided into a number of functional program modules seen in FIG. 4, each having a defined function in the game apparatus. The modules are at least the following:

Game Setup Module 101

This module is entered after power up to initialize certain variables used by the other modules. The game setup module will automatically pick five feet as the distance from the game apparatus. This is indicated by the number '5' flashing on the display 28 for two to three seconds. The module 101 then moves on to the other selections of game data which must be made by the players before the game can start. Upon the final selection, the game data are automatically set to the selected values, pointers to tables are stored and the state of the machine is preset to the first state.

End of Player/Game Over Module 102

This module is called after each stroke to determine if the game should advance to the next player or if the current game is over. Game-over and player-over conditions are preset by the Game Setup Module and vary from game to game. If the player is finished, this module will adjust pointers, etc. to point to the next player and return to the game. If the game is over, each player and the respective score will be flashed on the display several times before restarting the game.

Sound Control Module 103

This module processes sound generating functions. Every five hundred microseconds the module examines its current status. If a sound is currently active it will toggle the control line thereby producing a square wave. Each sound lasts for a preset period of time e.g. 100 msec. Once a sound is started by other modules the Sound Control Module will process it until it is completed.

Display Module 104

The display module 104 runs every 1.5 milliseconds to update the LEDs 21–24 and the three digit seven-segment display 28. If the state of the machine is monitoring travel distance the module only updates the seven-segment display 28 once per 1.5 ms. All other times the module will update not only the three digit display 28 but also the four LEDs 21–24, taking a total of five passes to process all the updates. The actual contents displayed are controlled by other modules.

Scores Computation Module 105

Using the selected, current game type, the event (center target hit, side target hit), and the difference between target distance and actual distance, points are awarded to the player. In some game selections, hitting one of the side targets will not give any points. The points given are totaled, then added to the player's current score. The contents are displayed by the Display Module 104 for preset periods of time.

When the ball velocity computation module 106 (see below) complete its function, the main program i.e. the finite state machine of FIG. 3 will enter the computed distance traveled by the ball. This module is primarily table-driven in that, given the initial velocity of the ball, the distance from the game apparatus and the selected greens speed is indexed as an address into speed tables to get the computed distance the ball would have travelled in an actual game. With this value as the 'target' distance, the display is updated with the distance of the user from the game apparatus added to the target distance. Other modules will handle the updates to the ball's current position and may add some randomness to the actual final distance traveled as obtained from a random number function in the computer.

Ball Velocity Computation Module 106

Figure 3:
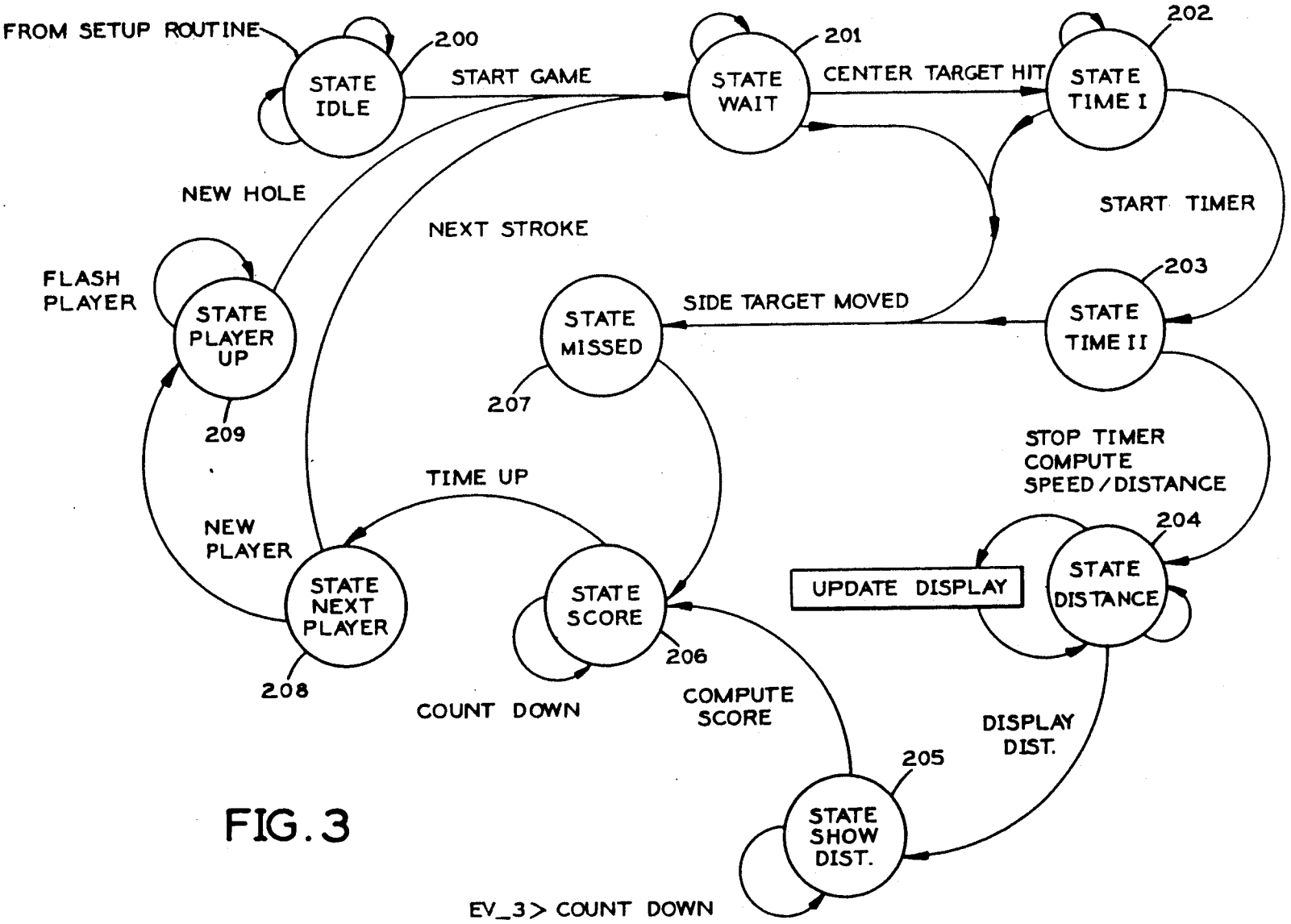
FIG. 3 is a state diagram of the control program for the invention showing its major states and events.

When the ball detection circuit with the photo sensor 33 generates an interrupt indicating movement of the target, an event is issued to the state machine FIG. 3. If the current state is awaiting a target detection event, the machine will start an internal clock and switch to the next state. Another event form the detection circuit will stop the internal clock and switch to another state. The distance computation module is called as an action routine for the event. The velocity is then computed by the formula:

$$\text{velocity} = \text{distance}/\text{time}$$

wherein the distance is known to be e.g. 4.67" as this is the circumference of the circle described by the point of impact on the target 11–13. The velocity is then converted to feet per second (fps).

Ball Detection Circuit

The ball detection section has both electrical and mechanical components. The targets 11, 12, 13 rotate about their horizontal axis when struck by the ball. On the upper end of each target is a reflective material 31, which will reflect the light from its respective LED 32. The reflected light is detected by the target's photodetector 33 component and will activate the microprocessor's interrupt line low. There are three targets 11, 12, 13 and three sets of photooptics components, LED's and photodetectors. The photodetectors associated with the two outside targets are connected together and, along with the photodetector of the center target connected to input pins on the microprocessor. Object code stored in the microprocessor's ROM will execute specific instructions based on the interrupt line being activated, e.g. pulled low.

FIG. 4 is a diagram of the main program 34, i.e. the state machine, with extensions reaching to the modules, described above, and some of the hardware described above, namely the target 31, the LED 32, and photo sensor 33. The switches 26,27 respectively advance a number to be entered according to the number of activations of the switch, and enter, i.e. "select" the number when switch 27 is operated. The display 28 is seen associated with the display module and the speaker 43 is associated with the sound control module.

It should be noted that the modules in FIG. 4 are all software programs stored in the ROM 41, whereas FIG. 2 shows the actual hardware and interfaces driven by the software modules.

FIG. 3 is a state diagram of the main program, showing the states 200–209 traversed by the program. In each state the program anticipates an event before it proceeds to the next state, as is well known in state "machines".

In state 200, "idle" the microprocessor has been initialized. In this state the microprocessor **34*a* tests the various components of the system to insure all are in operating condition, or any failure will be displayed to the user. Next it turns on the light 21 (FIG. 1), labeled "putt distance" from game unit, indicating that the processor 34 is expecting the user to select putting distance. By pressing the key 26, labeled "Advance", a number of times corresponding to the distance in feet to be selected, the user will enter the selected putting distance from a "hole". This distance is shown on the display 28, and may be from 5–9 feet. Next the user operates the key 27, labelled "select", and the selected distance will be entered into the computer RAM 42 as an item of game data, and the processor will indicate the next election to be entered, which will be the "Greens Speed" by illuminating LED 22. A system of selecting greens speeds in a speed range from 1 to 5 may be used, with 5 indicating the highest speed. For example, a flat smooth carpet would be 5, and an outdoor carpet 2 or possibly 3. Pressing the "select" key 27 again enters the selected speed value. Next the processor will indicate an LED 23**, labelled "Number of Players", that this selection is to be made in the manner as described above.

When the game begins, each time a ball hits a target 11–13, and sends it spinning, the reflected light from the spinning target will indicate to the microprocessor **34*a* which target that was hit and the speed of the ball, as described above. The expected distance of the ball will be computed on the basis of the computed speed of the ball and the greens speed entered, and displayed on the display 28. After a certain delay, the next player can start to play his ball, as will be indicated, e.g. by flashing the display 28**.

As an additional feature, a selection between various types of games can be made, if the game unit is so equipped. The selection of game type will be indicated on LED 26, labelled "Game Type".

Returning now to FIG. 3, in state 200 the processor anticipates the event that a player starts a game, which leads the processor to state 201, wherein it is determined whether the center target is hit, or not, which leads respectively to states 202 or 207. If a side target is hit state 207 leads to 206, in which a score is computed and displayed. In state 202 a timer is started. The elapse of a given time leads to state 203, in which, if also a side target were moved, the next state is state 207.

In state 207, if one of the side targets is moved, the next state becomes 206, wherein a computed score is displayed, from where the next state 208 is "next player", after a time out. In state 203, after second time pulse the next state is 204 in which distance is computed and displayed in state 205, followed by computation of the score, which is displayed in state 206, followed by a time lapse, after which "next player" is indicated in state 208, followed by next player starting in state 209.

The following are brief descriptions of various types of games that can be played on the game unit. It follows that numerous variations of games can be devised by proper programming, by means of game modules stored in the microprocessor memory:

GAME 1

"Shootout"

This game is played by 1 to 4 players, at four holes per game at a preset distance of 14, 18, 22 and 26 feet, with three putts per hole for each player, and one extra putt for three online putts in a row.

| Scoring: | |
|---|---|
| On-Line putt but incorrect distance | 25 points |
| On-Line putt and one foot short or two feet past the hole | 50 points |
| On-Line putt and only 5 ft. past hole | 75 points |

GAME 2

"Random Distance Shootout"

This game is played by 1 to 4 players, at twelve holes per game with random distance each hole, with three puts per turn for each player, and one extra putt for three on-line putts in a row.

| Scoring: | |
|---|---|
| On-Line putt but incorrect distance | 25 points |
| On-Line putt and 1 ft. short or 2 ft. past hole | 50 points |
| On-Line putt and only 5 ft. past hole | 75 points |

GAME 3

"Skins"

This game can be played with 2 to 4 players at four holes per game with random distance each hole, with three putts per turn for each player. Since only one player can win in Skins, a tie will carry over the point to the next hole.

| Scoring: | |
|---|---|
| On-Line putt and 1 ft. short or 2 ft. past hole | 1 point |

(Point awarded only if a single player wins. If game ends in a tie, we suggest you double the value of the next game.)

GAME 4

"Sudden Death"

This game is played by 1 to 4 players, at three holes per game at a preset distance of 15, 20, and 25 feet with three putts per turn for each player. The first player to make each hole wins the game. To make the hole, you need an on-line putt and 1 ft. short or 2 ft. past hole.

GAME 5

"Youngsters only Shootout"

This game is played by 1 to 4 players. Each player gets three putts per turn at a distance of 16 ft. Left and right targets will score 25 points but will not register distance.

| Scoring: | |
|---|---|
| Left or Right Target | 25 points |
| On-line putt but incorrect distance | 50 points |
| On-line putt but 2 ft. short or 2 feet past the hole | 100 points |

GAME 6

"Practice 1"

This game is for 1 player at a random distance for each putt. A count of total putts is displayed after each putt, then a total count of putts made is displayed to show progress for each practice session. Credit for a hole is given for an on-line putt and plus or minus 3 ft. of hole.

GAME 7

"Practice 2"

This game is played by 1 player at a random distance for every fifth putt. A count of total putts is displayed after each putt, then a total count of putts made is displayed to show progress for each practice session. Credit for a hole is given for an on-line putt and plus or minus 3 ft. of hole.

I claim:

1. A golf game apparatus comprising at least three rotatable targets activated by a golf ball, horizontal supporting means for rotatably supporting said targets, wherein each target has a rest position presenting a forward-facing target surface in said rest position; rotation-detecting means coupled to each target, computing means coupled to said rotation-detecting means for computing game-related parameters, and display means for displaying said parameters; a light-reflecting area on said rotating targets; a light source for illuminating said reflecting area; and a light sensor for sensing reflected light from said reflecting area coupled to said computing means for indicating rotation of said rotatable targets.

2. A golf game apparatus according to claim 1, including data storage means coupled to said computing means for receiving game-related data, said game-related data including at least putting distance from said golf game apparatus, greens speed, and game type.

3. A gold game apparatus according to claim 1, wherein said rotatable targets include a center target, at least one left target and at least one right target, and said horizontal supporting means include a horizontal shaft.

4. A gold game apparatus according to claim 3, including a housing having two opposite end panels for supporting said horizontal shaft at its ends; a face panel for holding said display means and a compartment for holding said computing means.

5. A golf game apparatus according to claim 1, wherein said computing means include a microprocessor, a program memory for storing control programs coupled to said microprocessor, and indicating means coupled to said microprocessor for indicating at least one of said game-related parameters.

6. A golf game apparatus according to claim 5, including light-emitting diodes and a numeric light-emitting diode (LED) display in said indicating means.

7. A golf game apparatus according to claim 5, wherein said control programs include a plurality of states, each state including at least one event for entry into said state.

8. A golf game apparatus according to claim 7, wherein said program includes at least one game module selected from the group of modules comprising a "shootout" module, and a "practice" module.

9. A golf game apparatus according to claim 1, wherein said game related parameters include at least computed ball speed, computed score and computed distance.

10. A golf game apparatus according to claim 1, wherein said computing means include at least one of a distance computation module, a ball velocity computation module, a game setup module, an end-of-player/-game-over module, a sound control module, a display control module and a score computation module.

11. A golf game apparatus comprising at least three freely rotatable targets activated by a golf ball; a horizontal shaft freely rotatably supporting said rotatable targets; each target being freely rotatable in a spinning motion about said horizontal shaft, and having a rest position presenting a forward-facing target surface in said rest position; rotation-detecting means coupled to each target; computing means coupled to said rotation-detecting means for computing speed of rotation of said rotatable targets and for computing game-related parameters; and display means for displaying said parameters.

12. A golf game apparatus according to claim 11, including data storage means coupled to said computing means for receiving game-related data, said game-related data including at least putting distance from said golf game apparatus, greens speed, and game type.

13. A golf game apparatus according to claim 11, wherein said computing means include a microprocessor, a program memory for storing control programs coupled to said microprocessor, and indicating means coupled to said microprocessor for indicating at least one of said game-related parameters.

14. A golf game apparatus according to claim 13, including light-emitting diodes and a numeric light-emitting diode (LED) display in said indicating means.

15. A golf game apparatus according to claim 13, wherein said control programs include a plurality of states, each state including at least one event for entry into said state.

16. A golf game apparatus according to claim 11, wherein said game related parameters include at least computed ball speed, computed score and computed distance.

17. A golf game apparatus according to claim 11, wherein said computing means include at least one of a distance computation module, a ball velocity computation module, a game setup module, an end-of-play/-game-over module, a sound control module, a display control module and a score computation module.

18. A golf game apparatus according to claim 11, including a housing having two opposite end panels for supporting said horizontal shaft at its ends; a face panel for holding said display means and a compartment for holding said computing means.

19. A golf game apparatus comprising at least three rotatable targets activated by a golf ball; a horizontal shaft rotatably supporting said rotatable targets; each target being rotatable about said horizontal shaft, and having a rest position presenting a forward-facing target surface in said rest position; rotation-detecting means coupled to each target; computing means coupled to said rotation-detecting means for computing speed of rotation of said rotatable targets and for computing game-related parameters; display means for displaying said parameters; a light-reflecting area on said rotating targets; a light source for illuminating said reflecting area; and a light sensor for sensing reflected light from said reflecting area coupled to said computing means for indicating rotation of said rotatable targets.

* * * * *